US007913522B2

(12) United States Patent
Park

(10) Patent No.: US 7,913,522 B2
(45) Date of Patent: Mar. 29, 2011

(54) WATER LEVEL SENSOR OF STEAM GENERATING APPARATUS FOR WASHING OR DRYING MACHINE AND STEAM GENERATING APPARATUS WITH THE SAME

(75) Inventor: Seog Kyu Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 320 days.

(21) Appl. No.: 11/629,301

(22) PCT Filed: Mar. 13, 2006

(86) PCT No.: PCT/KR2006/000891

§ 371 (c)(1),
(2), (4) Date: Nov. 21, 2008

(87) PCT Pub. No.: WO2006/098572

PCT Pub. Date: Sep. 21, 2006

(65) Prior Publication Data

US 2009/0107188 A1 Apr. 30, 2009

(30) Foreign Application Priority Data

Mar. 17, 2005 (KR) ..... 10-2005-0022283

(51) Int. Cl.
*D06F 39/04* (2006.01)

(52) U.S. Cl. ..... 68/5 R; 68/15; 68/207

(58) Field of Classification Search ..... 68/5 R, 68/5 C, 15, 207
See application file for complete search history.

(56) References Cited

U.S. PATENT DOCUMENTS

| | | | | |
|---|---|---|---|---|
| 1,961,893 | A * | 6/1934 | Wadman et al. | 414/161 |
| 2,653,304 | A * | 9/1953 | Wadsworth | 439/738 |
| 3,657,556 | A * | 4/1972 | Foster | 307/118 |
| 6,243,535 | B1 * | 6/2001 | Bochud | 392/459 |
| 6,513,377 | B1 * | 2/2003 | Sassi et al. | 73/304 R |
| 6,577,815 | B1 * | 6/2003 | Wu | 392/402 |
| 2003/0010117 | A1 * | 1/2003 | Shon | 73/304 R |
| 2004/0187527 | A1 * | 9/2004 | Kim et al. | 68/5 C |
| 2004/0187529 | A1 * | 9/2004 | Kim et al. | 68/207 |
| 2005/0034250 | A1 * | 2/2005 | Oh et al. | 8/159 |
| 2005/0034487 | A1 * | 2/2005 | Oh et al. | 68/5 C |
| 2005/0144735 | A1 * | 7/2005 | Yang et al. | 8/149.3 |
| 2006/0277690 | A1 * | 12/2006 | Pyo et al. | 8/149.2 |

FOREIGN PATENT DOCUMENTS

| | | |
|---|---|---|
| CN | 1580369 | 2/2005 |
| EP | 1507029 A2 | 2/2005 |
| EP | 1507031 A1 | 2/2005 |

(Continued)

*Primary Examiner* — Joseph L Perrin
(74) *Attorney, Agent, or Firm* — McKenna Long & Aldridge LLP

(57) ABSTRACT

A steam generator is used in a machine such as a clothes washing machine, a clothes drying machine, a clothes washing and drying machine, and the like and a level sensor is used in the same. More particularly, a level sensor is integrally formed by molding and conveniently assembled in the steam generator. The steam generator includes a case having a space for storing water, and formed with a level sensor insertion hole and a level sensor. The level sensor includes a conductor having a detector positioned in the space for storing the water and a connector electrically connected to the exterior, and a level sensor housing is inserted into the level sensor insertion hole and is integrally formed with the conductor by insert molding.

9 Claims, 3 Drawing Sheets

FOREIGN PATENT DOCUMENTS

| | | |
|---|---|---|
| JP | 60-059928 | 4/1985 |
| JP | 60-059929 | 4/1985 |
| JP | 60-059930 | 4/1985 |
| JP | 14-107203 | 4/2002 |
| KR | 10-2005-0017489 | 2/2005 |
| KR | 10-2005-0018182 | 2/2005 |

* cited by examiner

[Fig. 1]
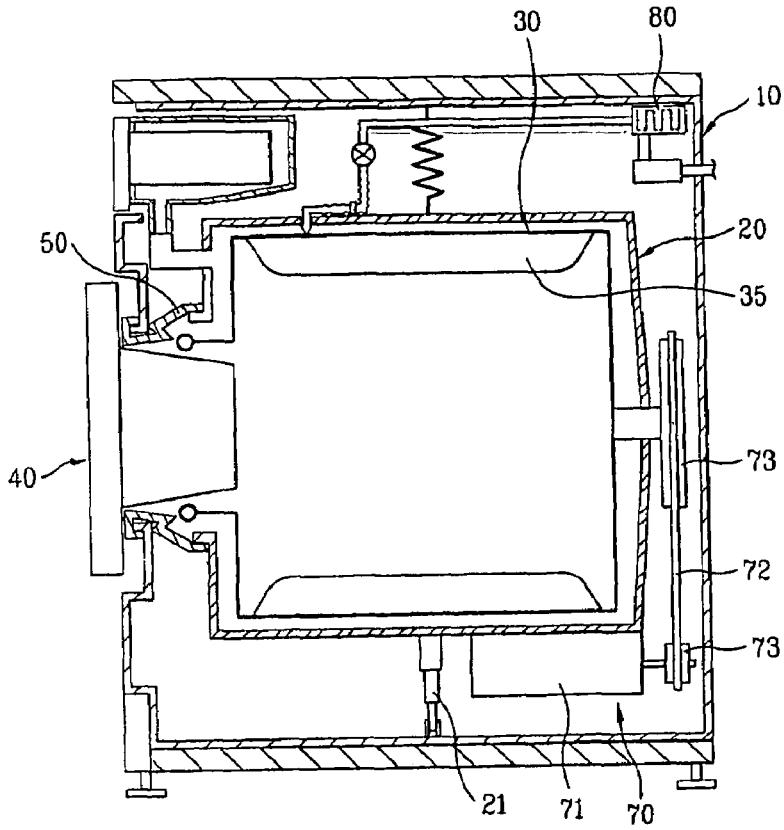
[Fig. 2]
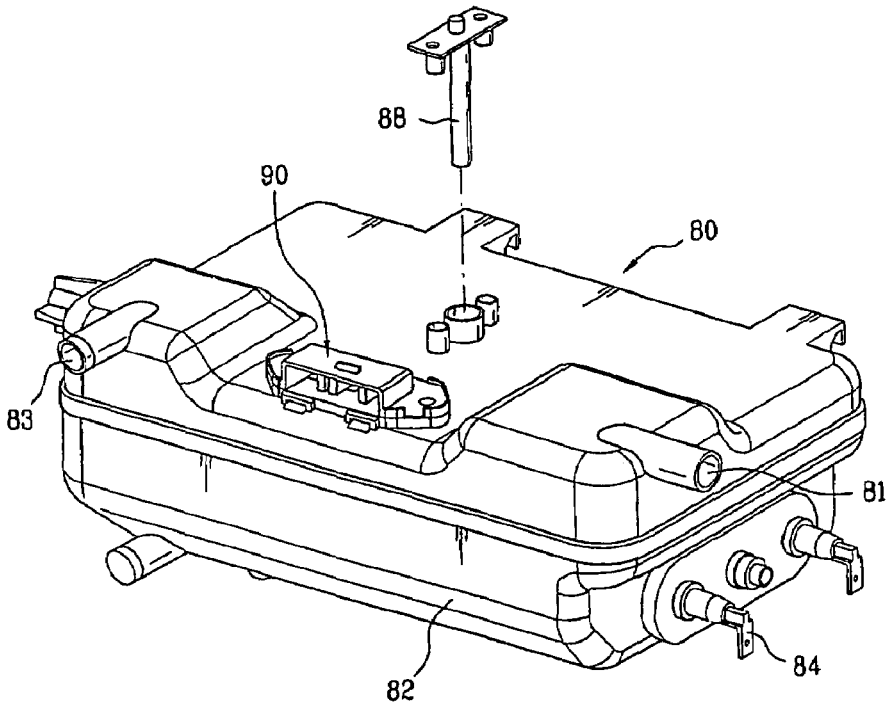

[Fig. 3]
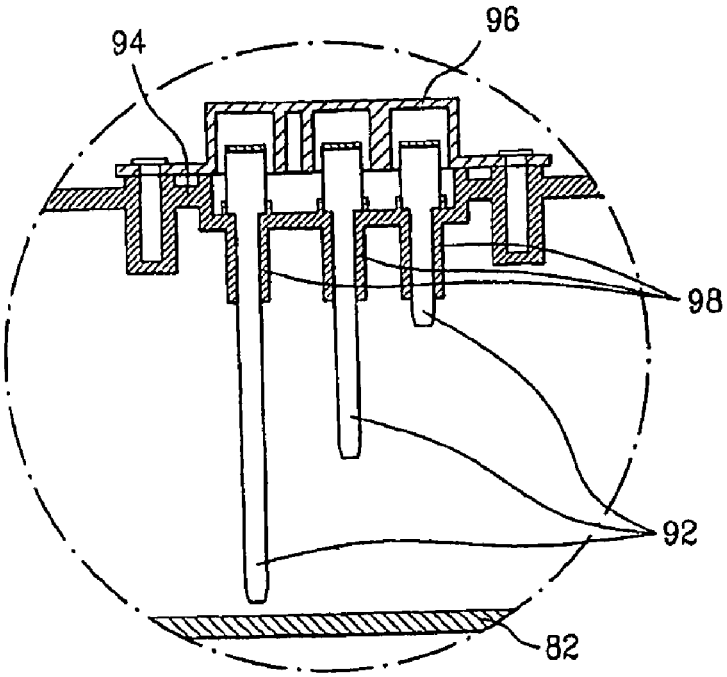
[Fig. 4]
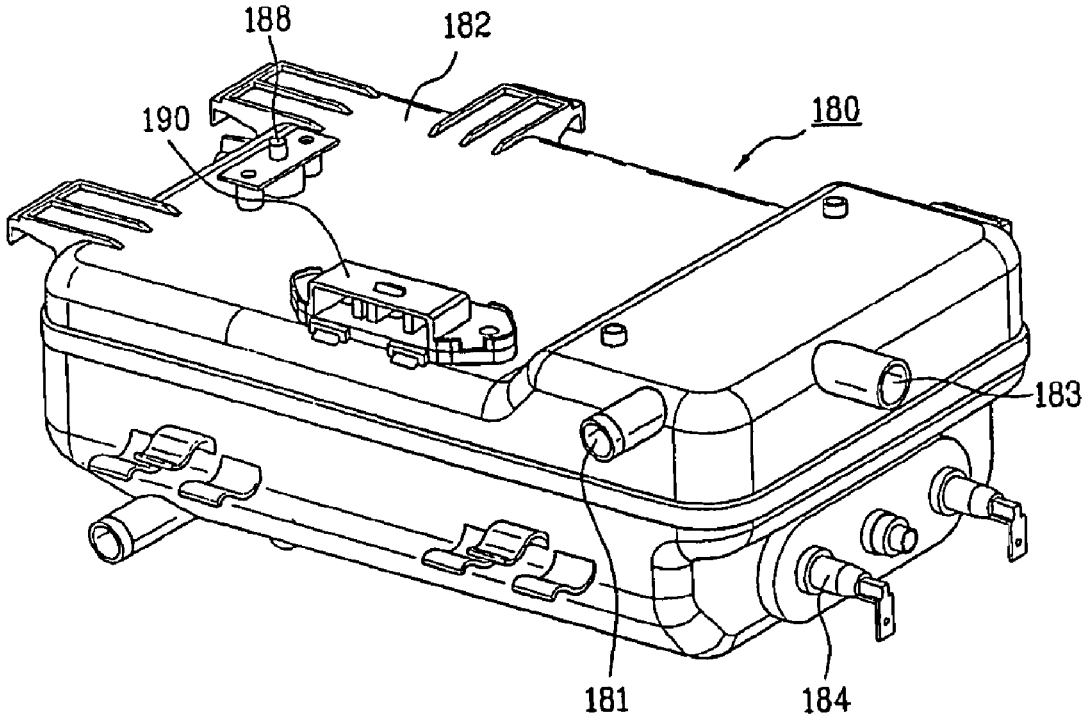

[Fig. 5]
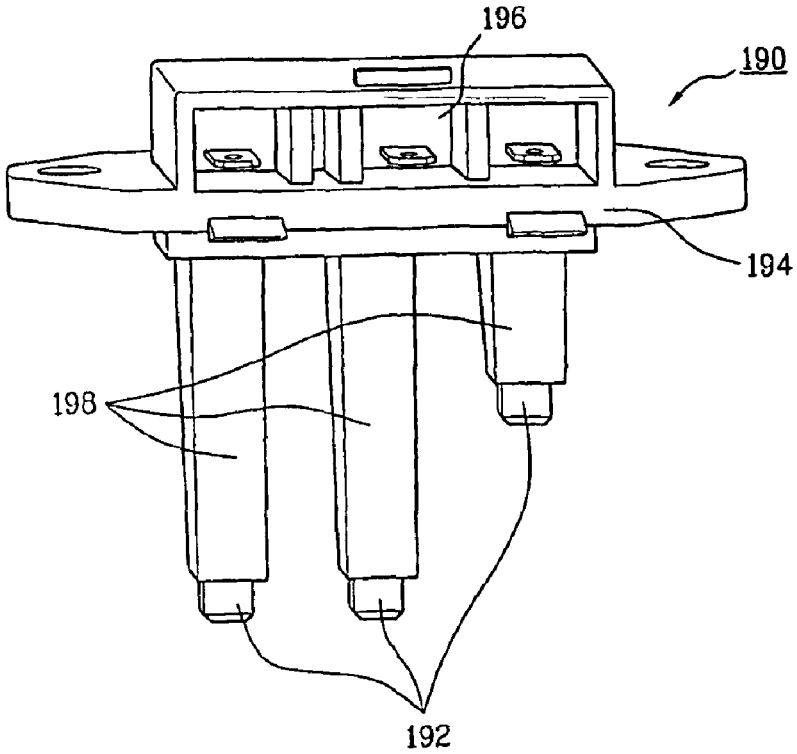
[Fig. 6]
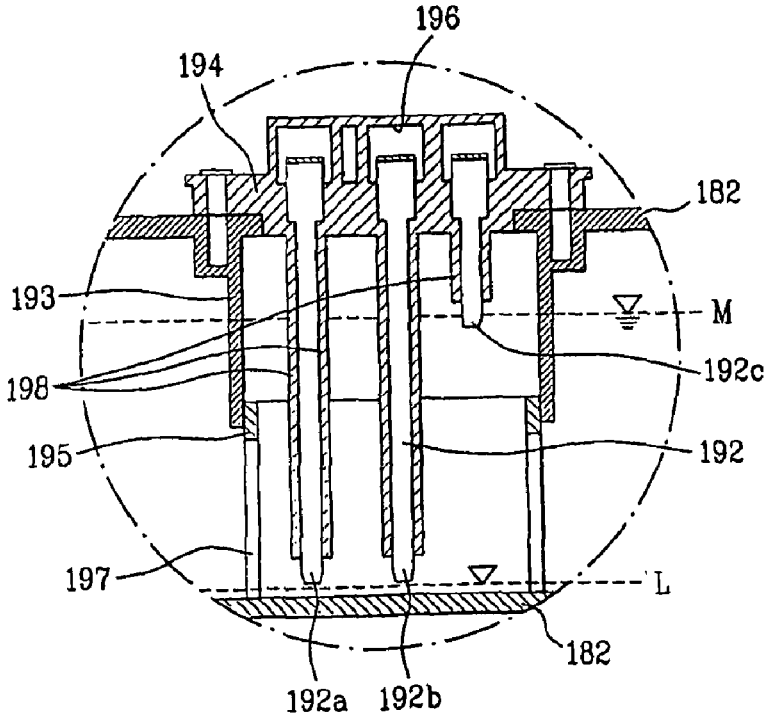

WATER LEVEL SENSOR OF STEAM GENERATING APPARATUS FOR WASHING OR DRYING MACHINE AND STEAM GENERATING APPARATUS WITH THE SAME

This application claims the benefit of Korean Patent Application No. 2005-0022283, filed on Mar. 17, 2005 and PCT Application No. PCT/KR2006/000891, filed on Mar. 13, 2006, which is hereby incorporated by reference for all purposes as if fully set forth herein.

TECHNICAL FIELD

This application claims the benefit of Korean Patent Application No. 10-2005-22283, which is hereby incorporated by reference as if fully set forth herein.

The invention relates to a steam generator used in a machine such as a clothes washing machine, a clothes drying machine, a clothes washing and drying machine, and the like and a water level sensor used in the same. In more particularly, the present invention relates to a water level sensor made to be one body by insert molding and able to be conveniently assembled in the steam generator.

BACKGROUND ART

Generally, clothes washing machines include a pulsator type clothes washing machine in which a drum is erected in the vertical direction, a drum type clothes washing machine in which a drum lays down, a clothes washing and drying machine having drying function, and a clothes drying machine for performing only drying function of clothes.

Specially, the drum type clothes washing machine among the clothes washing machines is an apparatus for performing the washing of laundry using friction generated between the drum rotated due to the driving force transmitted from a motor when detergent, washing water, and the laundry are supplied into the drum. According to the drum type clothes washing machine, the laundry is hardly damaged nor entangled. Moreover, the drum type clothes washing machine has an effect like washing of the laundry using a washing stick and by rubbing the laundry.

Hereinafter, the conventional drum type clothes washing machine will be described with reference to the accompanying drawings.

FIG. 1 is a vertical sectional view illustrating an inner structure of the conventional drum type clothes washing machine.

As shown in FIG. 1, the conventional drum type clothes washing machine includes a main body 10, a tub mounted in the main body 10, a drum 30 mounted to rotated in the tub 20 and having a lift 35 installed in the inner circumference thereof, and a driving device for driving the drum 30.

In the front side of the main body 10, a door 40 is provided at a predetermined position to correspond to an opening of the drum 30, and a gasket 50 is provided between the door 40 and the drum 30 to seal the drum 30.

Here, in the tub 20, dampers 21 are provided in the lateral lower sides of the outer circumference thereof and fixed in the main body 10.

The driving device 70 includes a driving motor 71 for driving the drum 30 and a belt 72 connected to a belt pulley 73 to transmit a driving force of the driving motor 71 to the drum 30.

In the drum type clothes washing machine structured as described above, a controller (not shown) for receiving command for washing the laundry from a user and controlling the clothes washing machine carries out the washing of the laundry while performing a washing cycle, a rinsing cycle, and a final dehydrating cycle sequentially.

In the washing cycle, contaminant is separated through detergent, and due to shock and friction generated due to a head that the laundry is lifted up and dropped down by the lift 35 and a bending and expanding movement of the laundry during the continuous rotation of the drum 30.

In the rinsing cycle, fresh washing water is supplied and the drum 30 is repeatedly rotated such that the remaining detergent and the contaminant generated during the washing cycle are separated from the laundry and the laundry is rinsed.

Moreover, in the final dehydrating cycle, the drum 30 is rotated at a high speed (approximately 800 RPM to 1300 RPM) such that the dehydrating process is carried out to dehydrate the laundry that is completely rinsed.

Recently, in order to save power consumption and the washing water supplied to the washing of the laundry, the clothes washing machine further includes a steam generator 80.

As shown in FIG. 2, the conventional steam generator 80 includes a case 82 having a space for storing water, and a beater 84 for heating the stored water.

Here, in a side of the case 82, a water supplying port 81 is connected to a water-supplying pipe (not shown) of the clothes washing machine to introduce the water into the case 82. In the opposite side of the case 82, a discharge port 83 is connected to a steam-supplying pipe (not shown) for supplying steam generated by heating the water introduced into the case 82 to the drum 30 of the clothes washing machine.

Meanwhile, in the intermediate region of the case 82, a temperature sensor 88 is provided to detect temperature of the water stored in the case 82.

Further, in order to prevent the heater 84 from being overheated resulting in damaging the heater 84 and peripheral components, a heater temperature sensor (not shown) such as a thermo-fuse is installed to an end of the heater 84.

In the upper side of the case 82, a water level sensor 90 is installed to detect the level of the water stored in the case 82.

FIG. 3 is a view illustrating a conventional level sensor.

As shown in the drawing, the conventional level sensor 90 includes a plurality of electrodes 92 extended toward the bottom of the case 82, a housing 94 fixed to the case 82 to support the electrodes 92, and a socket 96 into which a connector (not shown) for connecting the electrodes 92 to a controller (not shown) of the clothes washing machine is inserted.

The upper sides of the respective electrodes 92 are covered by a covering part 98 of the housing 94.

In other words, after inserting the respective electrodes 92 into the covering part 98 of the housing 94, the socket 96 is assembled to the upper side of the housing 94 and the housing 94 is assembled to the upper side of the case 82 so that the level sensor 90 is installed in the steam generator by way of assembling.

Thus, when the water is supplied into the case 82 up to a certain water level, the electrode corresponding to the water level is electrically connected to another electrode through the water.

However, the conventional level sensor of the clothes washing machine has disadvantages as follows.

Firstly, since the level sensor includes several components and needs several assembling processes, the productivity is deteriorated.

Secondly, the covering part surrounding the outsides of the electrodes covers only some of upper parts of the electrodes.

When vibration is applied to the case of the steam generator or the water in the case undulates during the water supply so that the water splashes around, a drop of water is placed between the uncovered portions of the electrodes so as to make the electrodes electrically connected so that the controller may erroneously detect the level in the case.

Thirdly, since there is a gap between the electrodes and the covering part of the housing, leakage caused by a capillary phenomenon may cause an electric leakage. Moreover, if sealing in order to prevent this problem, since work for the sealing is required, the productivity is deteriorated.

Furthermore, since the electrodes are inserted into the covering part of the housing, the covering part and the electrodes must be made in simple structures so as to make the insertion made easily. Thus, correspondingly, the covering part and the part of the electrodes inserted into the covering part are limited to be straight so that the installation position of the level sensor is limited to the position directly above the space for storing the water of the case.

DISCLOSURE OF INVENTION

Technical Problem

The present invention has been made in view of the above problems, and it is an aspect of the present invention to provide a water level sensor of a steam generator whose assembling processes are reduced and which is easily assembled such that the productivity is increased, and to provide the steam generator with the same.

It is another aspect of the present invention is to provide a level sensor of a steam generator prevented from erroneously detecting a level in spite of undulating of water in a case, to provide the steam generator with the same.

Moreover, without a separate sealing water is prevented from leaking out through a gap between electrodes and a housing surrounding the same.

Additionally, by taking the conventional assembly of a covering part and electrodes into consideration, the limitations of the covering part and the electrodes to be made in simple structures, and the installation position of a level sensor to be directly above the space for storing water are eliminated.

Technical Solution

In accordance with an aspect of the present invention, the above and other objects can be accomplished by the provision of a steam generator including a case having a space for storing water and formed with a level sensor insertion hole, and a level sensor.

Here, the level sensor includes a conductor for detecting a water level in the space for storing the water and a water level sensor housing inserted into the level sensor insertion hole, wherein the conductor and the housing are made to be one body by insert molding.

Since the conductor is made to be one body with the level sensor housing by insert molding, the level sensor is easily fabricated. Moreover, since the assembly of the level sensor to the case is completed only by inserting the level sensor into the level sensor insertion hole, the installation thereof is also easy and convenient.

Further, thanks to the insert molding, no gap is provided between the conductor and the housing so that the water leakage is prevented from happening between the conductor and the housing without additional sealing.

Moreover, thanks to the insert molding, there is no limit of a simple structure by taking the assembly of the level sensor into consideration. By doing so, the conductor may have a curved shape. Due to these advantages, the leakage is more securely prevented and the limit of the installation position of the level sensor becomes eliminated.

Additionally, when the conductor has a curved shape and the conductor and the housing are easily deformable, the depth of the level can be adjusted. For example, when a level to be measured is deep, the curved portion of the conductor can be unfolded to adjust the level to be measured.

Preferably, the level sensor housing includes a socket into which a plug is inserted, and an end of the conductor is positioned in the socket. Thus, in connection to a controller as an external device, when a plug of the controller is inserted into the socket, an end of the conductor is electrically connected to the plug so that the level sensor is electrically connected to the controller.

Moreover, the level sensor housing preferably includes a covering part for covering at least a part of the conductor positioned in the space for storing the water. In more preferably, the covering part extends to the end of the conductor.

According to the conventional technologies, since the covering part covers only the upper side of the conductor and a plurality of conductors are disposed near to each other, droplets are generated on the uncovered portions of the conductors and the conductors are electrically connected to each other, so that the detection precision of the level is deteriorated.

Thus, when the covering part extends to the end of the conductor, the problem generated in the conventional technologies can be solved.

Preferably, a plurality of conductors to detect a plurality of levels of the water can be included. In this case, the conductors include a common electrode, a lowest-level electrode for detecting the lowest level, and a highest-level electrode for detecting the highest level.

For the detection of the level using the electrodes, preferably, whether the electrodes are electrically connected to the common electrode is utilized. For example, when the water is supplied into the space for storing the water and whether or not the common electrode is electrically connected to the lowest-level electrode is checked, the level at the time when the electrical connection is checked is determined as the lowest level. The highest level is determined likewise.

As other method of detecting the level, there is a way using electric voltage of the electrodes. Since the electric voltage detected when the ends of the electrodes contact the water is different from that when not, the level may be detected using this fact.

In a case that a heater is exposed in the space for storing the water, the lowest level is preferably a level where at least a part of the heater is exposed out of the water. Thus, when the level of the water is below the lowest level, the heater is prevented from working so that problems caused by overheat can be prevented.

The highest level is preferably determined by taking a maximum quantity of the water stored in the space for storing the water into consideration. When the level of the water is equal to and higher than the highest level during the supply of the water into the space for storing the water, the supply of water is preferably stopped.

Moreover, the steam generator of the present invention may further include an undulating restricting means for restricting water around at least the end of the portion of, particularly below the conductor positioned in the space for storing the water from undulating.

If there is no undulating restricting means, although the present level reaches below the end of the conductor, the water undulates due to vibration or other reason and contacts the end of the conductor so that the level may be erroneously detected. The undulating restricting means prevents the erroneous detection of the level from being made.

Preferably, the restricting means is made in a form of wall around the end of the conductor. More preferably, the restricting means includes a lower wall protruded from the bottom of the case, and an upper wall protruded from the ceiling of the case.

As such, when there are the walls, although water undulates due to vibration, the undulation around the end of the electrode for detecting the level is prevented so that the level can be more precisely detected.

Here, the lower wall is formed with a penetrating slit through which the water flows, and the penetrating slit preferably extends to the lowest part of the wall.

In a case where a closed space is provided by the coupled lower wall and upper wall, the walls are formed with passageways such as water smoothly flows into the closed space where the conductor is disposed, and a passageway is preferably formed such that air remaining in the closed space is discharged by the introducing water.

Meanwhile, the level sensor of the present invention includes a level sensor housing including a socket into which a plug is inserted and a covering part, and a conductor covered by the covering part, wherein the housing and the conductor are made to be one body by insert molding. Here, the ends of the conductor are exposed, and one of them is positioned in the socket.

ADVANTAGEOUS EFFECTS

According to the present invention, in view of assembling the steam generator, the assembly is conveniently carried out, and, due to this point, the productivity is increased.

Moreover, despite of undulation of water in the case, the erroneous detection of the level is prevented so that the accuracy of detecting the level can be enhanced.

Additionally, without a specific sealing, a gap between the electrodes and the housing surrounding the same cannot be provided so that the water leakage through the gap is prevented.

BRIEF DESCRIPTION OF THE DRAWINGS

FIG. 1 is a vertical sectional view illustrating an inner structure of a conventional drum type clothes washing machine;

FIG. 2 is a perspective view illustrating a conventional steam generator;

FIG. 3 is a view illustrating a conventional level sensor in FIG. 2;

FIG. 4 is a perspective view illustrating a steam generator employing a level sensor of a steam generator of a clothes washing machine according to a preferred embodiment of the present invention;

FIG. 5 is a perspective view illustrating the level sensor of a steam generator of a clothes washing machine according to the preferred embodiment of the present invention; and FIG. 6 is a sectional view illustrating a case in which the level sensor in FIG. 5 is installed.

BEST MODE FOR CARRYING OUT THE INVENTION

Hereinafter, preferred embodiments of a steam generator of a clothes washing machine of the present invention capable of implanting the above objects and features of the present invention will be described in detail with reference to the accompanying drawings.

Wherever possible, the same reference numbers will be used throughout the drawings to refer to the same or like parts, and additional description for the same will be omitted.

FIG. 4 is a perspective view illustrating a steam generator employing a water level sensor according to a preferred embodiment of the present invention, FIG. 5 is a perspective view illustrating the level sensor of a steam generator according to the preferred embodiment of the present invention, and FIG. 6 is a sectional view illustrating a case in which the level sensor of a steam generator according to the preferred embodiment of the present invention is installed.

As shown in FIG. 4, the steam generator 180 according to this preferred embodiment of the present invention includes a water supply port 181 formed in a side of the steam generator to introduce water therein, and a case 182 formed with a discharge port 183 in which steam generated by heating the water introduced from the water supply port 181 is discharged to a drum 30 (See FIG. 1).

Here, the case 182 has a capacity capable of storing a predetermined amount of water therein.

Moreover, the case 182 includes a heater 184 installed therein to heat the water stored in the case 182.

Here, the heater 184 is preferably installed in the lower side of the case 182 to heat the water although the level of the water stored in the case is high or low.

Moreover, the heater 184 is preferably a sheath heater having a high thermal efficiency and capable of relatively heating water within a short time.

A temperature sensor 188 for detecting an interior temperature of the case 182 or the water temperature may be further provided.

A level sensor 190 for detecting a level of the water in the case 182 is provided.

The level sensor 190 is preferably installed in an upper side of the case 182.

In this embodiment, the level sensor 190, as shown in FIG. 5, includes at least one electrode 192 as a conductor for detecting the level of the water in the case 182, and a level sensor housing 194 integrally formed with the electrode by insert molding. Here, level sensor housing 194 includes a socket 196 into which a plug (not shown) of a controller is inserted and a covering part 198 for covering the electrode 192.

The electrode 192 is positioned in the socket 196 such that one end thereof is electrically connected to the plug and is coated with the covering part 198. Here, the opposite end of the electrode, as shown in the drawings, is exposed out of the covering part 198 and contacts water to detect the water level.

In more detail, as shown in FIG. 6, the electrode 192 extends from the upper side of the case 182 to the bottom of the case 182 by a predetermined length. Preferably, the electrode 192 includes a single common electrode 192*a* and a plurality of level electrodes 192*b* and 192*c* having different lengths. The level sensor depicted in the drawings includes a lowest-level electrode 192*b* for detecting the lowest level and a highest-level electrode 192*c* for detecting the highest level.

Here, the common electrode 192*a* extends near the bottom of the case 182 to contact the water until the water in the case 182 is totally disappeared.

Moreover, one of the level electrodes 192*b* and 192*c* has a length corresponding to a length of the common electrode 192*a* to be electrically connected to the common electrode 192*a* until the water in the case 182 is totally disappeared. The other of the level electrodes 192*b* and 192*c* extends downwardly to a height when water is fulfilled in the case 182 to be electrically connected to the common electrode 192*a* when the water is fulfilled in the case 182.

Never to say, the common electrode 192*a* can extend lower than the lowest-level electrode 192*b*.

In addition to the lowest-level electrode 192*b* and the highest-level electrode 192*c*, if necessary, a level electrode (not shown) may be further provided to extend to the intermediate portion of the case 182 to detect an intermediate level.

Moreover, the socket 196 is preferably formed in the upper side of the electrode 192 to be exposed out of the case 182.

The housing 194 is provided to support the respective electrodes 192 and to fix the respective electrodes 192 to the upper side of the case 182.

Moreover, the covering part 198 is preferably extends from the lower end of the housing 194 to surround the outer surface of the electrode 192.

Here, the covering part 198 surrounds the outer surfaces of the respective electrodes 192 except for the lower ends of the electrodes 192 such that the lower ends of the electrodes 192 are exposed in the case 182. This is to expose the ends of the electrodes 12 and to contact the water stored in the case 182 to detect the level.

Meanwhile, the electrodes 192, and the housing 194 including the socket 196 and the covering part 198 of the level sensor of a steam generator according to the preferred embodiment of the present invention are integrally formed by insert molding.

In other words, after the electrodes 192 are fabricated, the housing 194 is integrally formed with the electrodes 192 by the insert molding.

Here, the housing 194 of the level sensor including the socket 196 and the covering part 198 is preferably made of a plastic resin such that the insert molding is easily performed. More preferably, the housing 194 is made of a flexible material.

Moreover, according to the preferred embodiment of the present invention, a lower partition 195 and an upper partition 193 disposed around the electrodes 192 are further provided.

In more detail, the lower partition 195 protrudes upward from the bottom of the case 182 to be disposed around the electrodes 192.

Moreover, the upper partition 193, like the lower partition 195, preferably protrudes from the inner upper side of the case 182 to be disposed around the electrodes 19 such that there is a region where the lower end of the upper partition 193 is overlapped with the upper end of the lower partition 195.

Preferably, the lower partition 195 is formed with at least one penetrating slit 197 penetrating the lower partition 195 in the vertical direction such that the water stored in the case 182 is filled between the upper partition 193 and the lower partition 195.

Here, the penetrating slit 197 is formed such that the water in the case 182 fills a space defined by the lower partition 195 and the upper partition 193.

The level sensor of a steam generator of a clothes washing machine according to the preferred embodiment of the present invention works as follows.

Firstly, when the washing cycle of the clothes washing machine is started, water is introduced into the case 182 through the water supply port 181.

The water introduced into the case 182 is heated by the heater 184 and is transformed into steam, and the steam is introduced into the drum 30 (See FIG. 1) for accommodating laundry through the discharge port 183 to wet and soak the laundry resulting in enhancing washing efficiency.

Here, when water is fulfilled in the case 182 and the level becomes the highest-level M, since the common electrode 192, the lowest-level electrode 192*b*, and the highest-level electrode 192*c* are soaked in the water and electrically connected, the controller (not shown) determines this state as the highest level.

Moreover, when the water in the case 182 is disappeared and the level becomes the intermediate level, since the highest-level electrode 192*c* is exposed over the surface of the water such that the highest-level electrode 192*c* is not electrically connected to the common electrode 192*a* and the lowest-level electrode 192*b* and the common electrode 192*a* are soaked in the water to be electrically connected to each other, the controller (not shown) determines this state as the intermediate level.

Further, when the water in the case 182 is almost disappeared and the level is lowered down below the lowest level L, since the common electrode 192*a* and the lowest-level electrode 192*b* are exposed to air and are not electrically connected to each other, the controller (not shown) determines this state as the lowest level.

Meanwhile, a space is defined around the electrodes 192 by the upper partition 193 and the lower partition 195. Although the water stored in the case 182 is undulated during the supply of water or vibration transmitted from exterior, since the inside of the space is defined by the partitions, the undulation is reduced and the level is more precisely detected.

Moreover, when assembling the level sensor 190 of a steam generator of a clothes washing machine according to the preferred embodiment of the present invention to the case 182, since the level sensor 190 is fabricated into a single component by the insert molding such that the level sensor 190 is installed in the upper side of the case 182 to complete the assembly, the assembling process is simple and the productivity is increased.

INDUSTRIAL APPLICABILITY

The invention relates to a steam generator used in a machine such as a clothes washing machine, a clothes drying machine, a clothes washing and drying machine, and the like and a level sensor used in the same. In more particularly, the present invention relates to a level sensor integrally formed by molding and conveniently assembled in the steam generator.

According to the present invention, in view of assembling the steam generator, the assembly is conveniently carried out, and, due to this point, the productivity is increased.

Moreover, despite of undulation of water in the case, the erroneous detection of the level is prevented so that the accuracy of detecting the level can be enhanced.

Additionally, without a specific sealing, a gap between the electrodes and the housing surrounding the same cannot be generated so that the leakage is prevented.

The invention claimed is:

1. A steam generator of a clothes washing machine or a clothes drying machine comprising:

a case having a space for storing water wherein a water level sensor insertion hole formed therein; and a water level sensor comprising an electric conductor for detecting a water level in the space and a water level sensor housing fixed to the case to support the electric conductor, wherein the housing includes a covering part inserted into the water level sensor insertion hole to surround the conductor except for a lower end of conductor such that the lower end of the conductor is exposed in the case, and wherein the conductor and the housing are made to be one body by insert molding such that no gap is provided between the conductor and the housing.

2. The steam generator of a clothes washing machine or a clothes drying machine as set forth in claim 1, wherein the water level sensor housing includes a socket, and an upper end of the conductor is positioned in the socket.

3. The steam generator of a clothes washing machine or a clothes drying machine as set forth in claim 1, further comprising another at least one conductor to detect another water level.

4. The steam generator of a clothes washing machine or a clothes drying machine as set forth in claim 3, wherein all the conductors and the housing are made to be one body.

5. The steam generator of a clothes washing machine or a clothes drying machine as set forth in claim 1, further comprising an undulating restricting means for restricting water around at least the lower end of the portion of the conductor positioned in the space from undulating.

6. The steam generator of a clothes washing machine or a clothes drying machine as set forth in claim 5, wherein the undulating restricting means is made in a form of wall around the lower end of the conductor.

7. The steam generator of a clothes washing machine or a clothes drying machine as set forth in claim 6, wherein the undulating restricting means comprises:

a lower wall protruded from the bottom of the case; and an upper wall protruded from the ceiling of the case.

8. The steam generator of a clothes washing machine or a clothes drying machine as set forth in claim 7, wherein a slit is formed in the lower wall.

9. A steam generator of a clothes washing machine or a clothes drying machine comprising:

a case having a space to store water;

a water level sensor to detect a water level in the space, the water level sensor including:

a common electrode;

a lowest-level electrode for detecting the lowest level;

a highest-level electrode for detecting the highest level;

a housing including a socket configured to expose upper sides of the electrodes out of the case and a covering part to surround lower sides of the electrodes except for lower ends of the electrodes such that the lower ends of the electrodes are exposed in the case, wherein the electrodes and the housing are integrally formed as one body by insert molding such that no gap is provided between the electrodes and the housing.

* * * * *